US005283149A

United States Patent [19]

Tyagi et al.

[11] Patent Number: 5,283,149

[45] Date of Patent: Feb. 1, 1994

[54] ELECTROSTATOGRAPHIC TONER INCLUDING A WAX COATED PIGMENT AND METHOD FOR THE PREPARATION THEREOF

[75] Inventors: Dinesh Tyagi, Fairport; Donna A. DiPrima; Louis J. Sorriero, both of Rochester, all of N.Y.

[73] Assignee: Eastman Kodak Company, Rochester, N.Y.

[21] Appl. No.: 890,053

[22] Filed: May 28, 1992

[51] Int. Cl.[5] ..... G03G 9/097

[52] U.S. Cl. ..... 430/137; 430/106

[58] Field of Search ..... 430/106, 109, 137

[56] References Cited

U.S. PATENT DOCUMENTS 4,535,049 8/1985 Honda et al. ..... 430/137
4,789,617 12/1988 Arahara et al. ..... 430/137
4,833,060 5/1989 Nair et al. ..... 430/137
4,835,084 5/1989 Nair et al. ..... 430/137
4,965,131 10/1990 Nair et al. ..... 427/222
5,176,978 1/1993 Kumashiro et al. ..... 430/137

*Primary Examiner*—John Goodrow
*Attorney, Agent, or Firm*—Willard G. Montgomery

[57] ABSTRACT

A method is described for the preparation of electrostatographic toner particles which involves the surface treatment of a pigment by depositing thereon a coating of a low melting point wax. The method involves preparing a mixture of a wax solution and a pigment dispersion which is heated to a temperature sufficient to assure dissolution of wax and permitting the mixture to cool slowly to room temperature at which point a coating of wax is deposited upon the surface of the pigment. The wax coated pigment particles are then used as a component of the organic phase in a limited coalescence process.

19 Claims, No Drawings

ELECTROSTATOGRAPHIC TONER INCLUDING A WAX COATED PIGMENT AND METHOD FOR THE PREPARATION THEREOF

FIELD OF THE INVENTION

This invention relates to a method for the preparation of polymeric powders suitable for use as electrostatographic toner, and more particularly, to a method for the preparation of toner particles including a dispersed surface active pigment coated uniformly with a hydrophobic wax.

BACKGROUND OF THE INVENTION

Electrostatic toner polymer particles are commonly prepared by a process commonly referred to as "limited coalescence." In this process, polymer particles having a narrow size distribution are obtained by forming a solution of a polymer in a solvent that is immiscible with water, dispersing the polymer/solvent solution in an aqueous medium containing a solid colloidal stabilizer, and removing the solvent. The resultant particles are then isolated, washed, and dried.

In the practice of this technique, toner particles are prepared from any type of polymer that is soluble in a solvent that is immiscible with water. Thus, the size and size distribution of the resulting particles can be predetermined and controlled by the relative quantities of the particular polymer employed, the solvent, the quantity and size of the water insoluble solid particulate suspension stabilizer and the size to which the solvent-polymer droplets are reduced by the agitation employed.

Limited coalescence techniques of this type have been described in numerous patents pertaining to the preparation of electrostatic toner particles because such techniques typically result in the formation of toner particles having a substantially uniform size and uniform size distribution. Representative limited coalescence processes employed in toner preparation are described in U.S. Pat. Nos. 4,833,060 and 4,965,131.

In the conventional limited coalescence techniques described heretofore, the judicious selection of toner additives such as charge control agents and pigments permits control of the surface roughness of toner particles by taking advantage of the aqueous organic interphase present. However if any toner additive employed for this purpose is highly surface active or hydrophilic in nature, it tends to be present at the surface of the toner particles. Unfortunately, this leads to numerous potential problems such as lower charge/mass, rougher particles, poor thermal transfer, poor electrostatic transfer, reduced pigment coverage, interference with the limited coalescence process, sensitivity to environment, and the like.

Accordingly, workers in the art have recognized that toner additives must either be avoided or kept away from the particle surface. One method for obviating this limitation is to select an additive which is neither surface active or hydrophilic in nature. However, it is often not feasible to find an alternative additive evidencing the properties sought. Thus, it then becomes necessary to modify the surface of the additive.

Efforts to achieve this end have generally focused upon the use of suitable dispersion aids as, for example, polymers with acid or other polar functionality as described in copending application Ser. No. 501,819, filed by M. Nair. Z. Pierce and D. Tyagi. These polymeric stabilizers are used to treat carbon pigment to prevent the hydrophilic carbon from migrating to the surface. Toners prepared in this manner evidence enhanced electrostatic transfer, reduced electrical conductivity, and low D-min or fog.

A similar treatment employed in conjunction with toners of smaller particle size has frequently been found unsuccessful due to an increase in solution viscosity of the organic phase at the concentration of dispersant and pigment level employed. Limited coalescence toners prepared with an organic phase of this type tend to yield particles of broad size distribution and tend to interfere with the limited coalescence process. Furthermore, use of this technique requires the presence of reactive sites on the additive surface of the toner particles to which a dispersant may associate.

Recently, a technique was described in copending application Ser. No. 890,057, filed May 28, 1992, entitled, "Electrostatographic Toner and Method for the Preparation Thereof", for obviating the foregoing limitations wherein a highly surface active pigment was coated with a hydrophobic wax which is insoluble in the solvents commonly employed in toner preparation. Studies revealed that the wax coating prevents the pigment from migrating to the surface of the toner and provides a spherical surface thereto. This results in a narrow distribution of charge from particle to particle and permits image transfer without the occurrence of fog in the background. The wax coating also reduces the likelihood of surface contamination by the pigment due to the fact that it is kept away from the surface. Particulate material prepared in accordance with this technique evidences charging characteristics that render the particles suitable for use as electrostatographic toner particles. Unfortunately, this technique cannot be used when fine dispersion is desired since the melt dispersion process is not efficient. For that purpose, a dispersion made by media milling is appropriate.

SUMMARY OF THE INVENTION

In accordance with the present invention, this end has been attained by a novel process in which a pigment dispersion is treated in a system which takes advantage of the solubility differences of a wax in a solvent such as ethyl acetate at various temperatures. Thus, for example, it has been observed that some waxes are soluble in ethyl acetate at elevated temperatures but are insoluble at ambient conditions. Accordingly, it is then feasible to dissolve a wax in ethyl acetate at elevated temperatures and introduce a pigment dispersion thereto. In order to obviate the likelihood of premature wax precipitation upon introduction of the pigment dispersion it is advantageous to heat the latter prior to mixing with the wax solution. Following this introduction, the mixture is permitted to cool slowly while stirring, so resulting in the wax precipitating out on the pigment as a coating thereon and changing its surface activity.

Viewed from one aspect, the present invention is directed to a method for the preparation of electrostatographic toner. The method comprises the steps of dissolving a low melting point wax in a solvent at an elevated temperature, admixing the resultant solution with a heated pigment dispersion in colloidal form, and permitting the mixture to cool slowly to ambient conditions, the wax precipitating upon the pigment surface during the cooling process; recovering the wax coated pigment particles from the mixture and mixing therewith a polymer material, a solvent and optionally a charge control agent to form an organic phase; dispersing the organic phase in an aqueous phase comprising a particulate stabilizer and optionally a promoter, and homogenizing the mixture; and evaporating the solvent and washing and drying the resultant product.

Viewed from another aspect, the present invention is directed to a process for preparing electrostatographic toner by dispersing an organic phase in an aqueous phase to yield a layer of particulate suspension stabilizer on the surface of a polymer. The improvement in the process comprises forming a wax coated pigment dispersion by dissolving a low melting point wax in a solvent at an elevated temperature and mixing the resultant solution with a heated pigment dispersion and permitting the mixture so formed to cool slowly to room temperature, so resulting in the precipitation of the wax on the surface of the dispersion of pigment. The coated pigment particles are then mixed with a polymer material, a solvent and optionally a charge control agent to form the organic phase in the aforementioned limited coalescence process.

These and other features and advantages of the present invention will be better understood taken in conjunction with the following detailed description and claims.

DETAILED DESCRIPTION OF THE INVENTION

In accordance with the present invention, a pigment dispersion is prepared by conventional techniques as, for example, by media milling, melt dispersion and the like. Next, a low melting point wax evidencing a low degree of crystallinity, a molecular weight of 20,000 or less and a melting point within the range of 55°-120° C. is dissolved in a solvent at a temperature just below the boiling point of the solvent. The pigment dispersion prepared as described is then heated, for example, to about the same temperature as the wax solution and admixed therewith. The resultant mixture is then permitted to cool slowly to ambient temperature. In this process, the wax present in solution slowly precipitates upon the surface of the dispersed pigment as the mixture cools.

Following this step, the coated pigment dispersion is mixed with a polymer material, a solvent and optionally a charge control agent to form an organic phase in which the pigment concentration is chosen to range from about 1 to 40%, by weight, based upon the total weight of solids. A preferred range has been found to range from 4 to 20%, by weight. The charge control agent is employed in an amount ranging from about 0-10 parts per hundred, based on the total weight of solids, with a preferred range from about 0.2-3.0 parts per hundred. This mixture is permitted to stir overnight and then dispersed in an aqueous phase comprising a particulate stabilizer and optionally a promoter.

The solvents chosen for use in the wax dissolution and organic phase steps may be selected from among any of the well known solvents capable of dissolving waxes and polymers of the type employed herein. Typical of the solvents chosen for this purpose are chloromethane, dichloromethane, ethyl acetate, vinyl chloride, methylethylketone, trichloromethane, carbon tetrachloride, ethylene chloride, trichloroethane, toluene, xylene and the like. Ethyl acetate has been found to be a particularly useful solvent for dissolution of waxes in accordance with the invention. Dichloromethane has been found to be particularly useful for dissolving polymers of the type employed herein.

The solvent used for dissolving the wax should be capable of dissolving it at a temperature above ambient temperature, e.g., above about 20° C., to permit effective coating deposition thereof on the milled pigment particles upon cooling the combined ingredients.

The particulate stabilizer selected for use herein may be selected from among highly cross-linked polymeric latex materials of the type described in U.S. Pat. No. 4,965,131 issued on Oct. 23, 1990 to M. Nair et al. or silicon dioxide. Each of these stabilizers has colloidal dimensions and is well suited for use in the practice of the present invention. The particulate stabilizer is generally used in an amount ranging from 1 to 15 parts based on 100 parts of the total solids employed.

Any suitable promoter that is water soluble and affects the hydrophilic/hydrophobic balance of the solid dispersing agent in the aqueous solution may be employed in order to drive the solid dispersing agent, that is, the particulate stabilizer, to the polymer/solvent droplet-water interface. It will be appreciated by those skilled in the art that the promoter is required only when silica is employed as the stabilizing agent. When latex is employed for this purpose, the hydrophobic/hydrophilic characteristics are provided by the choice of co-monomers used. Typical of such promoters are sulfonated polystyrenes, alginates, carboxy methyl cellulose, tetramethyl ammonium hydroxide or chloride, diethylaminoethylmeythacrylate, water soluble complex resinous amine condensation products such as the water soluble condensation products of diethanol amine and adipic acid, water soluble condensation products of ethylene oxide, urea and formaldehyde and polyethyleneimine. Also effective for this purpose are gelatin, glue, casein, albumin, gluten and the like or nonionic materials such as methoxycellulose. The promoter is generally used in an amount ranging from about 0.2 to 0.6 parts per 100 parts of aqueous solution.

Various additives generally present in electrostatographic toner may be added to the polymer prior to dissolution in the solvent or in the dissolution step itself, such as charge control agents. Suitable charge control agents are disclosed, for example, in U.S. Pat. Nos. 3,893,935; 4,079,014; 4,323,634 and British Patent Nos. 1,501,085 and 1, 420,839. Charge control agents are generally employed in small quantities such as from about 0 to about 10 parts per hundred based upon the weight of the total solids content (weight of the toner) and preferably from about 0.2 to about 3.0 parts per hundred.

The resultant mixture is then subjected to mixing and homogenization. In this process, the particulate stabilizer forms an interface between the organic globules in the organic phase. Due to the high surface area associated with small particles, the coverage by the particulate stabilizer is not complete. Coalescence continues until the surface is completely covered by particulate stabilizer. Thereafter, no further growth of the particles occurs. Accordingly, the amount of the particulate stabilizer is inversely proportional to the size of the toner obtained. The relationship between the aqueous phase and the organic phase, by volume, may range from 1.5:1 to approximately 9:1 . This indicates that the organic phase is typically present in an amount from about 10% to 40% of the total homogenized volume.

Following the homogenization treatment, the solvent present is evaporated and the resultant product washed and dried.

As indicated, the present invention is applicable to the preparation of polymeric toner particles from any type of polymer that is capable of being dissolved in a solvent that is immiscible with water and includes compositions such as, for example, olefin homopolymers and copolymers, such as polyethylene, polypropylene, polyisobutylene and polyisopentylene; polyfluoroolefins, such as polytetrafluoroethylene and polytrifluorochloroethylene; polyamides, such as polyhexamethylene adipamide, polyhexamethylene sebacamide, and polycaprolactum; acrylic resins, such as polymethylmethacrylate, polymethylyacrylate, polyethylmethacrylate and styrene-methylmethacrylate; ethylene-methyl acrylate copolymers, ethylene-ethyl acrylate copolymers, ethylene-ethyl methacrylate copolymers, polystyrene and copolymers of styrene thereof with unsaturated monomers, cellulose derivatives, polyesters, polyvinyl resins and ethylene-allyl alcohol copolymers and the like.

Pigments suitable for use in the practice of the present invention should be capable of being media milled, or otherwise commingled and dispersed and thus be dispersible in the solvent and be insoluble in the aqueous phase and yield strong, permanent color. Typical of such pigments are the organic pigments such as phthalocyanines, lithols and the like and inorganic pigments such as $TiO_2$, carbon black and the like. Typical of the phthalocyanine pigments are copper phthalocyanine, mono-chlor copper phthalocyanine, and hexadecachlor copper phthalocyanine. Other organic pigments suitable for use herein include anthraquinone vat pigments such as vat yellow 6GLCL1127, quinone yellow 18-1, indanthrone CL1106, pyranthrone CL1096, brominated pyranthrones such as dibromopyranthrone, vat brilliant orange RK, anthrimide brown CL1151, dibenzanthrone green CL1101, flavanthrone yellow CL1118; azo pigments such as toluidine red C169 and hansa yellow; and metallized pigments such as azo yellow and permanent red. The carbon black may be of any of the known types such as channel black, furnace black, acetylene black, thermal black, lamp black and aniline black. The pigments are employed in an amount sufficient to give a content thereof in the toner from about 1 to 40%, by weight, based upon the weight of the toner, and preferably within the range of 4 to 20%, by weight.

The waxes chosen for use in the practice of the present invention are insoluble at room temperature in the solvents employed but soluble at elevated temperatures and may be selected from among any of the high molecular weight waxes evidencing a molecular weight of 20,000 or less and having a melting temperature within the range of 55°-120° C. These waxes are commonly available from commercial sources. Ethyl acetate has been found to be the preferred solvent for use in the wax dissolution step.

Waxes found to be particularly useful for this purpose include UNILINS (manufactured by Petrolite Co.), CERAMERS (manufactured by Petrolite Co.), EPOLENE (manufactured by Eastman Kodak Co.), and ELWAX (manufactured by Eastman Kodak Co.). The waxes chosen for use herein should be less surface active than the pigment, and should be hydrophobic relative to the hydrophilic surface of the media milled surface active pigment.

The invention will be more fully understood by reference to the following exemplary embodiment which is set forth solely for purposes of exposition and is not to be construed as limiting.

EXAMPLE 1

A solution of ELWAX 40W (melting point 70° C.) was prepared in ethyl acetate at 70° C. by adding 2.5 grams of wax to 145.6 grams of ethyl acetate. 62.59 grams of a media milled dispersion of quinacridone magenta was also heated to a temperature of 80° C. The dispersion was prepared from a mixture of 76.9 grams of the quinacridone magenta pigment, 15.49 grams of a commercially available surfactant (Salsperse 24,000) and 7.7 grams of butyl acrylate-styrene copolymer (PICCOTONER 1221 manufactured by Hercules-Sanyo, Inc.) in 769.2 grams of ethyl acetate (13% solids mixture). Then, the hot (70° C.) wax solution was slowly added to the hot (80° C.) media milled dispersion of pigment.

The concentration of wax employed was maintained at a pigment to wax ratio of 2.5:1. The mixture so prepared was then permitted to cool to room temperature slowly, so resulting in the precipitation of a coating of wax upon the surface of the pigment. 10.625 grams of the surface treated pigment was then added to 39.9 grams of a butyl acrylate-styrene copolymer (PICCOTONER 1221),in ethyl acetate and 0.5 gram of tetradecyl pyridinium tetraphenyl borate (a charge control agent) while stirring for two hours. Next, the mixture was added to an aqueous phase comprising 750 milliliters of a buffer having a pH of 10 and 50 milliliters of latex particles (3solids content) of the type described in U.S. Pat. No. 4,965,131. Then, the mixture was subjected to shear using a Polytron sold by Brinkman followed by a Microfluidizer. Upon exiting, the solvent was removed from the particles so formed by stirring overnight at 25° C. in an open container. The particles formed were found to have a particle size ranging from about 2 to 5 microns in size. These particles were then washed with water and dried. The particles evidenced a size distribution ranging from 3 to 4 microns and are useful as electrostatographic toner.

In order to compare toners prepared in the foregoing manner with those of the prior art, surface morphologies were studied for different preparative techniques. Thus, for example, a quinacridone magenta latex limited coalescence toner prepared in accordance with conventional prior art limited coalescence evidenced an irregular surface due to the accumulation of magenta pigment at the surface of the toner during the coalescence process. Generally, the use of a more hydrophobic magenta pigment such as hydrophobic Fanal Pink (a rhodamine) has been found to result in the formation of pigment having more of a spherical shape. Micrographs obtained by studying the quinacridone containing latex toner particles prepared as described herein reveal that the spherical nature of the toner is greatly enhanced as the amount of the wax employed is increased. Accordingly, wax encapsulation of the surface of the pigment in the manner described is shown to be highly beneficial. Furthermore, since it is known that the quinacridone based magenta limited coalescence toners evidence low charge and poor charge stability, any effort to avoid its proximity to the surface of the toner will result in an enhancement of the triboelectric performance. This assertion is vindicated by reference to Table I set forth below which contrasts the charging behavior of toner prepared with wax encapsulation (as described herein) and without wax encapsulation.

TABLE I

| Sample Ex | Pigment | Wax | Q/M[uC/gm.] Fresh | |
|---|---|---|---|---|
| LC516 or LC413D | 20% Hostaperm Pink | None | 123 | 72 |
| AA9528-106 | 12.5% Hostaperm Pink | 5% Elwax 40W | 134 | 128 |
| AA9528-109 | 12.5% Hostaperm Pink | 10% Elwax 40W | 57 | 51 |

As is clear from Table I, after exercise (Ex) for 5 minutes by passing the toner over a magnetic brush rotating at 2,000 rpm in a sealed jar, the charge per mass ratio (Q/M) of the toners prepared according to this invention declined only slightly, i.e., 4.5%, from 57 to 51 (uC/gm.) in the case of 5% ELWAX 40W, and 10.5%, from 134 to 128 (uC/gm.) in the case of 10% ELWAX 40W. On the other hand, in the absence of the wax encapsulation according to this invention, the charge to mass ratio (Q/M) of the convetional toner declined markedly after exercise, i.e., 41.5%, from 123 to 72 (uC/gm.). Toner particles prepared according to this invention maintain a relatively stable charge in use whereas the comparable prior art toner particles are relatively unstable in use.

While the invention has been described in detail with reference to certain preferred embodiments, it will be understood that variations may be made by those skilled in the art without departing from the spirit and scope of the invention. Thus, for example, different polymer compositions, waxes, solvents and pigments may be substituted for those employed in the example.

What is claimed is:

1. A method for the preparation of electrostatographic toner comprising the steps of:
   (a) dissolving a low melting point wax in a first solvent heated to a temperature sufficient to dissolve the wax, thereby forming a solution;
   (b) mixing the solution with a pigment dispersion heated to a temperature approximating that of the solution and permitting the resultant mixture to cool slowly to ambient temperature, so resulting in the precipitation of wax upon the surface of the pigment and recovering the wax coated pigment particles;
   (c) mixing the said pigment particles with a polymer material, a solvent and optionally a charge control agent to form an organic phase;
   (d) dispersing the organic phase in an aqueous phase comprising a particulate stabilizer and optionally a promoter and homogenizing the resultant mixture; and
   (e) evaporating the solvent and washing and drying the resultant product.

2. The method of claim 1 wherein the pigment employed comprises from about 4 to 20%, by weight of total solids including wax.

3. The method of claim 1 wherein the wax is a hydrophobic wax and is employed in an amount ranging from about 20 to 200%, by weight, of the pigment employed.

4. The method of claim 1 wherein the relationship between the aqueous phase and the organic phase, by volume, ranges from about 1.5:1 to 9:1.

5. The method of claim 1 wherein the low melting point wax has a melting point within the range of 55°-120° C.

6. The method of claim 1 wherein the solvent is ethyl acetate.

7. The method of claim 1 wherein the particulate stabilizer is selected from the group consisting of highly cross-linked latex particles and $SiO_2$.

8. The method of claim 1 wherein the dispersion comprises media milled quinacridone magenta.

9. The method of claim 1 wherein the polymer is butyl acrylate-styrene coploymer.

10. In a method for preparing electrostatographic toner by dispersing an organic phase in an aqueous phase to yield a layer of particulate suspension stabilizer on the surface of a polymer, the improvement which comprises forming a wax coated pigment dispersion by dissolving a low melting point wax in a heated solvent, mixing the resultant solution with a heated pigment dispersion and permitting the mixture so formed to cool slowly to room temperature whereby wax coats the surface of the particles of the pigment dispersion, and mixing the wax coated pigment particles with a polymer material, and a charge agent to form an organic phase for dispersing in the aqueous phase.

11. The method of claim 11 wherein the low melting point wax has a melting point within the range of 55°-120° C.

12. The method of claim 11 wherein the solvent is ethyl acetate, and the polymer is a butyl acrylate-styrene coploymer.

13. The method of claim 12 wherein the pigment dispersion comprises quinacridone magenta.

14. The method of claim 13 wherein the pigment to wax ratio in the pigment dispersion-wax solution is about 2.5:1.

15. The method of claim 14 wherein the wax has a melting temperature of approximately 70° C.

16. A method of preparing a uniform coating of a low melting point wax on pigment particles comprising the steps of:
   (a) forming a solution of the low melting point wax in a solvent therefor at a temperature sufficient to dissolve the wax;
   (b) mixing the wax solution with a pigment particle dispersion in a dispersing liquid at a temperature sufficient to prevent premature precipitation of the wax from the resulting mixture;
   (c) slowly cooling the mixture to room temperature at a rate sufficient to deposit the wax on the pigment particles as a coating on the surface of the particles; and
   (d) recovering the coated pigment particles.

17. A method in accordance with claim 16 wherein the dispersing liquid is water.

18. Electrostatographic toner prepared in accordance with the method of claim 1.

19. Electrostatographic toner prepared in accordance with the method of claim 10.

* * * * *